US006693990B1

(12) United States Patent
Andrews

(10) Patent No.: US 6,693,990 B1
(45) Date of Patent: Feb. 17, 2004

(54) LOW THERMAL RESISTANCE BEARING ASSEMBLY FOR X-RAY DEVICE

(75) Inventor: Gregory C. Andrews, Sandy, UT (US)

(73) Assignee: Varian Medical Systems Technologies, Inc., Palo Alto, CA (US)

( * ) Notice: Subject to any disclaimer, the term of this patent is extended or adjusted under 35 U.S.C. 154(b) by 14 days.

(21) Appl. No.: 09/855,591

(22) Filed: May 14, 2001

(51) Int. Cl.[7] ..... H01J 35/10

(52) U.S. Cl. ..... 378/132; 378/119; 378/133; 378/125; 378/127; 378/130

(58) Field of Search ..... 378/132, 133, 378/125, 119, 127, 130, 143; 384/261

(56) References Cited

U.S. PATENT DOCUMENTS

| | | | | | |
|---|---|---|---|---|---|
| 3,634,870 | A | * | 1/1972 | Kessler | 313/60 |
| 3,735,176 | A | | 5/1973 | Langer et al. | 313/60 |
| 3,855,492 | A | | 12/1974 | Langer et al. | 313/60 |
| 3,942,059 | A | | 3/1976 | Tran-Quang | 313/60 |
| 4,005,322 | A | | 1/1977 | Koller | 313/60 |
| RE30,082 | E | | 8/1979 | Atlee et al. | 313/57 |
| 4,187,442 | A | | 2/1980 | Hueschen et al. | 313/60 |
| 4,272,696 | A | | 6/1981 | Stroble et al. | 313/60 |
| 4,413,355 | A | * | 11/1983 | Matsumoto | 378/127 |
| 4,470,645 | A | | 9/1984 | Lauwasser | 308/184 |
| 4,870,672 | A | | 9/1989 | Lindberg | 378/129 |
| 4,949,368 | A | | 8/1990 | Kubo | 378/132 |
| 4,953,190 | A | | 8/1990 | Kukoleck et al. | 378/129 |
| 4,988,534 | A | * | 1/1991 | Upadhya | 427/307 |
| 5,056,126 | A | * | 10/1991 | Klostermann et al. | 378/127 |
| 5,148,463 | A | | 9/1992 | Woodruff et al. | 378/144 |
| 5,150,397 | A | | 9/1992 | Randzaao | 378/129 |
| 5,157,706 | A | | 10/1992 | Hohenauer | 378/144 |
| 5,159,619 | A | | 10/1992 | Benz et al. | 378/143 |
| 5,308,172 | A | | 5/1994 | Upadhya et al. | 384/453 |
| 5,414,748 | A | | 5/1995 | Upahya | 378/144 |
| 5,553,114 | A | | 9/1996 | Siemers et al. | 378/129 |
| 5,838,762 | A | | 11/1998 | Ganin et al. | 378/125 |
| RE36,405 | E | * | 11/1999 | Akita et al. | 384/147 |
| 6,011,829 | A | | 1/2000 | Panasik | 378/130 |
| 6,041,100 | A | | 3/2000 | Miller et al. | 378/141 |
| 6,125,168 | A | * | 9/2000 | Bhatt | 378/132 |
| 6,125,169 | A | * | 9/2000 | Wandke et al. | 578/127 |
| 6,144,720 | A | * | 11/2000 | DeCou et al. | 378/129 |

* cited by examiner

*Primary Examiner*—Craig E. Church
*Assistant Examiner*—Jurie Yun
(74) *Attorney, Agent, or Firm*—Workman Nydegger

(57) ABSTRACT

A bearing assembly for a rotating anode x-ray device. The bearing assembly includes a shaft having a flange at one end for attachment of the anode thereto. The shaft defines front and rear inner races and includes a plurality of extended surfaces. Front and rear outer race elements define front and rear outer races, respectively, corresponding to the front and rear inner races, respectively, defined by the shaft. The front and rear outer race elements cooperate with the shaft to confine front and rear ball sets which facilitate rotary motion of the shaft. A spacer including extended surfaces assists in the positioning of the front and rear outer race elements in a bearing housing. The extended surfaces of the shaft and spacer, in conjunction with emissive coatings provided on various portions of selected components of the bearing assembly, facilitate a relative improvement in heat transfer out of the bearing assembly.

31 Claims, 4 Drawing Sheets

LOW THERMAL RESISTANCE BEARING ASSEMBLY FOR X-RAY DEVICE

BACKGROUND OF THE INVENTION

1. The Field of the Invention

The present invention relates generally to x-ray tubes that employ a target anode rotatably supported by a bearing assembly. More particularly, embodiments of the present invention relate to systems and structures concerned with improving the rate that heat is transferred away from the x-ray tube bearing assembly and thereby minimize destructive thermal conditions that occur during operation of the x-ray tube.

2. The Relevant Technology

X-ray producing devices are valuable tools that are used in a wide variety of industrial, medical, and other applications. For example, such devices are commonly used in areas such as diagnostic and therapeutic radiology, semiconductor manufacture and fabrication, and materials analysis and testing. While they are used in various applications, the different x-ray devices share the same basic underlying operational principles. In general, x-rays, or x-ray radiation, are produced when electrons are emitted, accelerated, and then impinged upon a material of a particular composition.

Typically, these processes are carried out within a vacuum enclosure. Disposed within the vacuum enclosure is an electron source, or cathode, and an anode, which is spaced apart from the cathode. In operation, electrical power is applied to a filament portion of the cathode, which causes a stream of electrons to be emitted by the process of thermionic emission. A high voltage potential applied across the anode and the cathode causes the electrons emitted from the cathode to rapidly accelerate towards a target surface, or focal track, positioned on the anode.

The accelerating electrons in the stream strike the target surface, typically a refractory metal having a high atomic number, at a high velocity and a portion of the kinetic energy of the striking electron stream is converted to electromagnetic waves of very high frequency, or x-rays. The resulting x-rays emanate from the target surface, and are then collimated through a window formed in the x-ray tube for penetration into an object, such as the body of a patient. As is well known, the x-rays can be used for therapeutic treatment, x-ray medical diagnostic examination, material analyses, or other procedures.

In addition to stimulating the production of x-rays, the kinetic energy of the striking electron stream also causes a significant amount of heat to be generated. Some of this heat is often conducted to other areas of the x-ray tube and, as discussed further below, can result in thermal stresses that damage the tube.

In addition to the heat generated as a result of the primary electron stream, other sources of destructive heat are present within the operating x-ray tube. For example, a percentage of the electrons that strike the target surface of the anode do not generate x-rays, and instead simply rebound from the surface and then impact other surfaces and structures within the x-ray tube evacuated enclosure. These are often referred to as "secondary" electrons. These secondary electrons retain a large percentage of their kinetic energy after rebounding, and when they impact non-target surfaces, a significant amount of heat is generated that is conducted to various other elements, such as the bearing assembly, of the x-ray device. Thus, non-target structures, as well as the anode, are routinely exposed to extremely high operating temperatures.

The heat produced by secondary electrons combined with the high temperatures generated at the target anode, often reaches levels high enough to damage portions of the x-ray tube structure and components. In fact, the resulting thermal stresses often shorten the operational life of the x-ray device, affect its efficiency and performance, and/or render it inoperable. These high temperatures can be especially problematic in rotating anode type x-ray tubes.

In a typical rotating anode type x-ray tube, the anode is mounted to a shaft of a bearing assembly confined within a bearing housing. Generally, the bearing assembly includes front and rear bearings having respective sets of balls confined within front and rear races disposed circumferentially with respect to the shaft. Because the balls are free to travel along the races, the shaft of the bearing assembly can freely rotate but is desirably constrained from any substantial axial movement. A stator serves to impart rotational movement to the shaft and the connected anode. As the anode rotates, each point on the focal track is rotated into and out of the path of the electron beam generated by the cathode. In this way, the electron beam is in contact with a focal spot on the focal track for only short periods of time, thereby allowing the remaining portion of the focal track to cool during the time that it takes such given portion to rotate back into the path of the electron beam.

The rotating anode x-ray tube of this sort is used in a variety of applications, some of which require that the anode be rotated at relatively high speeds so as to maintain an acceptable heat distribution along the focal track. For instance, x-ray tubes used in mammography equipment have typically been operated with anode rotation speeds around 3500 revolutions per minute (rpm). However, the demands of the industry have continued to change and high-speed machines for mammography and other applications are now being produced that operate at anode rotation speeds of around 10,000 rpm and higher. Moreover, the rotation must be exact; any wobble or non-uniform rotation of the anode greatly reduces the operating efficiency of the x-ray tube, or may render it imoperable. These high rotational speeds, coupled with the need for rotational precision, make the rotating anode structure—especially the bearing assembly—especially susceptible to the high operating temperatures.

For example, high operating temperatures can result in undesirable temperature differentials in the bearing assembly. Because the front bearing is located relatively closer to the anode than the rear bearing, the front bearing is exposed to relatively higher temperatures than is the rear bearing. Since the heat transmitted to the bearing assembly from the anode is not evenly distributed and dissipated, such an arrangement results in a temperature differential between the front and rear bearings. The relatively higher temperature experienced at the front bearing effectively reduces the maximum bulk operating temperature of the anode to a point somewhat lower than what the anode could be safely exposed if at least some of the heat experienced at the front bearing was more evenly distributed or otherwise dissipated. This effectively limits the operating power of the x-ray tube.

One solution to this problem is to use a relatively larger anode having a higher heat absorption capability. However, larger anodes are undesirable due to higher costs and because they are heavier and more difficult to balance and rotate at higher speeds.

In addition to acting as a limitation on the maximum operational temperature of the anode, the temperature differential between the front and rear bearings also has negative implications with respect to the operation of the bearings, and thus, the x-ray device as a whole. In particular, because thermal expansion is at least partially a function of temperature, the relatively greater temperature at the front bearing results in a relatively greater expansion of the front bearing, considered with respect to the expansion of the rear bearing. A thermal expansion differential between the front and rear bearings, can cause unbalanced, or otherwise improper, rotation and operation of the shaft which is supported by the bearings. Unbalanced shaft rotation, or similar defects, may cause, among other things, undesirable drifting or movement of the focal spot and degradation of resulting x-ray image quality.

Not only are temperature differentials in the bearings associated with various undesirable and destructive effects, but excessively high temperatures, in general, have a variety of undesirable consequences with respect both to the life and operation of the bearings, and thus of the x-ray device as a whole. For example, extreme operating temperatures may cause increased vibration and noise in the bearing assembly. Such noise and vibration are further exacerbated by the high rotational speeds of the rotating anode. Bearing noise and vibration are undesirable because they can be unsettling to a patient, particularly in applications such as mammography where the patient is in intimate contact with the x-ray machine. Moreover, noise and vibration may be distracting to the x-ray machine operator. Also, unchecked vibration can shorten the operating life of the x-ray tube over time. Finally, the quality of the images produced by the x-ray device is at least partly a function of the stability of the focal spot on the target surface. Thus, vibration may compromise the quality of the x-ray image by causing undesirable movement of the focal High rotational speeds and high operating temperatures cause vibration and noise in the bearing assembly for a number of reasons. For example, high temperatures can melt the thin film metal lubricant, typically silver or lead, that is present on the bearing surfaces. When the bearings cool, the metal lubricant may clump and create rough spots in the races. Upon subsequent start-up of the x-ray device, the balls travel at high speeds over the rough spots in the races, thereby causing vibration and noise. Moreover, repeated exposure to high temperatures can degrade the bearings, thereby reducing their useful life, as well as that of the x-ray tube.

Heat may be especially problematic depending on the physical arrangement of the components in the bearing assembly and bearing housing, and the materials from which those components are constructed. In particular, in some known designs, operating heat is conducted directly to the bearing assembly by way of solid metal parts that collectively form a heat path between the anode and the bearing assembly. Additional heat is also generated in the bearing assembly as a result of bearing friction, which generally increases as operating speeds increase.

The resulting heat can cause the physical connections or interfaces in the shaft and bearing assembly to loosen and vibrate. Loosening can occur when the components of the bearing assembly are constructed of different metals that have different thermal expansion rates. In such a case, the various parts will each expand and contract at different respective rates when heated and cooled.

For example, the bearing housing is typically constructed of copper, or a copper alloy. The bearings, which are generally constructed of a steel alloy are captured in a cavity defined by the housing. As the copper housing heats up, the diameter of the cavity increases more quickly than the outside diameter of the bearings, thereby creating a gap between the bearing and the cavity wall. The gap thus created allows the bearings to move axially within the housing and thereby generate noise and vibration.

Such problems are of particular concern in the new generation of high-power rotating anode x-ray tubes that have relatively higher operating temperatures than the typical devices. In general, high-powered x-ray devices have operating powers that exceed 20 kilowatts (kw).

Various attempts have been made to minimize the thermal stress, strain, vibration, noise, and other consequences of high operating temperatures—especially in bearing assemblies. In general, such attempts typically have focused on removing heat from the x-ray device through the use of various types of x-ray tube cooling systems. However, such approaches have not been entirely satisfactory in resolving these problems. For example, in a typical liquid cooling arrangement a volume of a dielectric coolant is contained in a reservoir in which the x-ray tube is disposed. An external cooling unit continuously circulates coolant through the reservoir and removes heat transmitted to the coolant by the x-ray tube. However, this approach does not sufficiently remove heat in high-power x-ray tubes, nor is it directed specifically to the unique cooling requirements of the bearing assembly. That is, while such systems remove heat from the x-ray tube, they may nevertheless be ineffective in removing sufficient heat from localized "hot spots" such as the bearing assembly. As a result, the bearing assembly may operate improperly and/or fail prematurely, thereby shortening the useful life of the x-ray device.

Other attempts to control the destructive effects of operational heat on the bearing assembly have focused on providing emissive coatings on or near the anode. As in the case of liquid cooling systems however, such approaches suffer from a variety of shortcomings which serve to impair their effectiveness.

For example, the repeated heating and cooling cycles to which the x-ray device components are typically exposed may cause emissive coatings to flake or spall away from the coated surface. This debris can then contaminate other components within the x-ray tube, and lead to the premature failure of such components. Moreover, there is often a thermal "mismatch" between the surface of the coated component and the emissive coating. This thermal expansion rate differential tends to weaken the bond between the two materials over time, which can again lead to flaking and spalling of the emissive coating.

With respect to emissive coatings, another complicating factor relates to the coating process. In particular, the coating process must be monitored carefully and subjected to strict quality control standards in order to reduce the likelihood of spalling and related defects that could result from an improperly applied coating. Such monitoring and quality control, while somewhat effective in some cases, may nevertheless add significantly to the manufacturing complexity and overall cost of the x-ray device.

Another attempt to reduce the heat levels in bearing assembly involves the use of heat shields or similar structures interposed between the bearing assembly and the anode. Typically, the heat shield is attached to the underside of the anode, proximate the bearing assembly. Heat radiated from the target is then deflected, or redirected, by the heat shield so that it does not pass into the bearing assembly. While such heat shields are somewhat effective in reducing the amount of heat radiated to the bearing assembly, they fail to address the problem of heat transfer from the target to the bearing assembly by conduction. Thus, known heat shields are of limited effectiveness because they address only one of the vehicles by which heat is transferred to the bearing assembly.

In view of the foregoing problems, and others, it would be an advancement in the art to provide an improved bearing assembly which includes features directed to providing for a relative increase in the rate at which heat is rejected from the bearing assembly, and which thereby contributes to a relative increase in the operational life of the bearing assembly, and thus the operational life of the x-ray device as a whole.

BRIEF SUMMARY OF EMBODIMENTS OF THE INVENTION

The present invention has been developed in response to the current state of the art, and in particular, in response to these and other problems and needs that have not been fully or adequately resolved by currently available bearing assemblies. Briefly summarized, embodiments of the present invention provide a bearing assembly that includes various features directed to facilitating a relative increase in the rate at which heat is rejected from the bearing assembly.

Embodiments of the present invention are particularly well suited for use in the context of rotating anode type x-ray tubes. However, it will be appreciated that embodiments of the present invention are suitable for use in any environment where it is desired to efficiently and reliably remove heat from bearing assemblies, and related components, that are exposed to high operating temperatures.

In one embodiment of the present invention, a bearing assembly is provided that includes a shaft defining front and rear inner races, arranged circumferentially about the body of the shaft, and each including a respective bearing surface. The bearing surfaces of the inner races defined by the shaft are blackened, preferably by an oxidation process that produces an $Fe_3O_4$ (iron oxide) coating on the bearing surfaces. The shaft further includes one or more extended surfaces, preferably disposed circumferentially about the shaft body. In one embodiment of the invention, the extended surface takes the form of an increased shaft diameter.

The bearing assembly additionally includes front and rear outer race elements disposed about the shaft so as to be aligned with the front and rear inner races defined by the shaft. As in the case of the inner races, the front and rear outer races include respective bearing surfaces that are blackened, preferably by an oxidation process that produces an $Fe_3O_4$ (iron oxide) coating on the bearing surfaces. The front and rear outer races cooperate with, respectively, the front and rear inner races to confine front and rear sets of balls. Finally, a spacer longitudinally separates the front and rear outer race elements, and thus serves to position such front and rear outer race elements. Preferably, the spacer includes a plurality of extended surfaces proximate to the extended surfaces of the shaft.

In operation, the balls in the front and rear races permit the shaft to rotate freely. Because the balls are confined in the races however, the shaft is desirably constrained from any substantial axial movement. Heat transmitted to the bearing assembly, whether by conduction and/or radiation, is radiated from the shaft of the bearing assembly by way of the extended surfaces of the shaft. The extended surfaces thus facilitate a relative increase in the rate of heat transmission from the shaft. Further, because the spacer preferably includes extended surfaces proximate the extended surfaces of the shaft, the spacer absorbs heat radiated by the shaft. The spacer then conducts the absorbed heat to the bearing housing in which the bearing assembly is received. This heat is then removed, at least indirectly, from the bearing housing, preferably by way of a liquid cooling system. Thus, the shaft and the spacer cooperate to desirably reduce the temperature differential, or thermal gradient, along the shaft, and also facilitate a relatively higher level of heat transfer from the bearing assembly than would otherwise be possible.

The blackened bearing surfaces, particularly those in the front inner and outer races, likewise contribute to the reduction of the thermal gradient. In particular, the enhanced emissivity provides a relative increase in heat transfer away from the bearing surfaces, and the temperature of the front bearing, and other components of the bearing assembly, is accordingly reduced.

To summarize, the improved thermal characteristics of embodiments of the invention have several advantages. The service life and reliability of the bearing assembly, and component parts, is improved by the increased rate of heat transfer facilitated by the various extended surfaces, and blackened surfaces, of the bearing assembly. Further, the extended surfaces permit a relative reduction in the thermal gradient along the length of the shaft, thereby contributing to improved heat distribution through the shaft, and reducing the operating temperatures in the front bearing. The improved rates of heat transfer permit a corresponding increase in the bulk operating temperature of the anode, permitting the use of relatively smaller anodes. These and other features and advantages contribute to an increase in the life of the bearing assembly, and thus of the x-ray device as a whole.

These, and other, features and advantages of the present claimed invention will become more fully apparent from the following description and appended claim, or may be learned by the practice of the invention as set forth hereinafter.

BRIEF DESCRIPTION OF THE DRAWINGS

Understanding that these drawings depict only typical embodiments of the invention and are not therefore to be considered limiting of its scope, the invention will be described and explained with additional specificity and detail through the use of the accompanying drawings in which.

DETAILED DESCRIPTION OF VARIOUS EMBODIMENTS

Reference will now be made to figures wherein like structures will be provided with like reference designations. It is to be understood that the drawings are diagrammatic and schematic representations of various embodiments of the claimed invention, and are not to be construed as limiting the present claimed invention, nor are the drawings necessarily drawn to scale.

Figure 1:
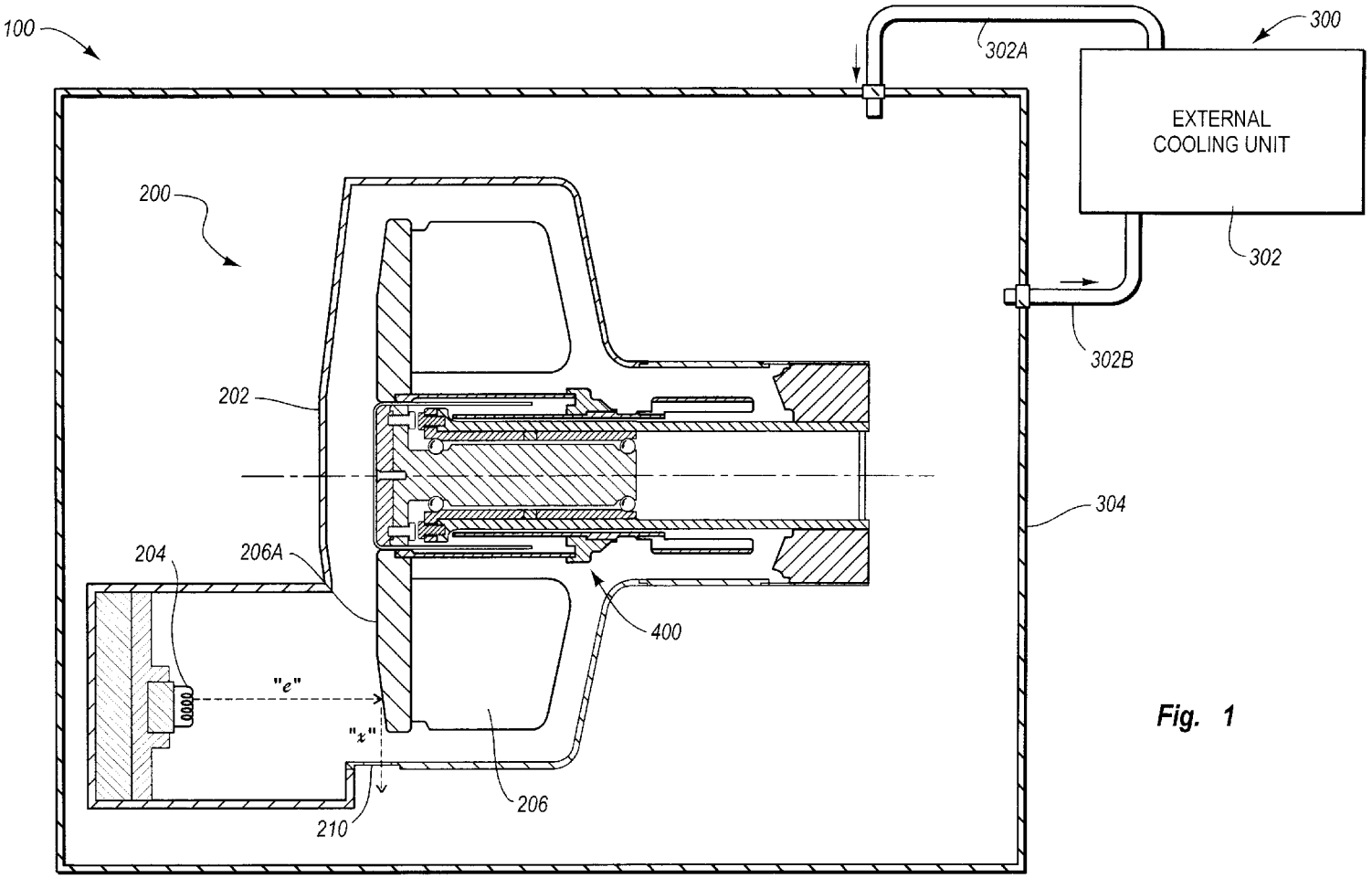
FIG. 1 is a top view illustrating various features of an embodiment of an x-ray device.

Reference is first made to FIG. 1, wherein an x-ray device is indicated generally at 100. In general, x-ray device 100 includes an x-ray tube 200 that generates x-rays, and an x-ray tube cooling system 300 that serves to remove at least some of the heat produced as a result of the x-ray generation process. It will be appreciated that the x-rays produced by x-ray tube 200 may be employed in any of a variety of applications, and embodiments of the present invention should accordingly not be construed to be limited to any particular field of application.

As indicated in the illustrated embodiment, x-ray tube 200 includes a vacuum enclosure 202, inside which is disposed an electron source 204, preferably comprising a cathode or the like, and an anode 206 rotatably supported by a bearing assembly 400 and arranged in a spaced-apart configuration with respect to electron source 204. Anode 206 further includes a target surface 206A, preferably comprising a refractory metal such as tungsten or the like, arranged so as to receive electrons emitted by electron source 204. The x-rays produced by x-ray tube 200 are directed out of vacuum enclosure 202 by way of a window 210, preferably comprising beryllium or the like.

With continuing attention to FIG. 1, details are provided regarding various operational features of x-ray device 100. In operation, a stator (not shown) causes anode 206 to rotate at high speed. Power applied to electron source 204 causes electrons, denoted at "e" in FIG. 1, to be emitted by thermionic emission and a high voltage potential applied across electron source 204 and anode 206 causes the emitted electrons "e" to rapidly accelerate from electron source 204 toward anode 206. Upon reaching anode 206, electrons "e" strike target surface 206A causing x-rays, denoted at "x" in FIG. 1 to be produced. The x-rays "x" are then collimated and passed through window 210 and into a subject, for example, the body of a patient.

While electrons "e" are being emitted from electron source 204, anode 206 rotates at high speed so that the portion of target surface 206A that is exposed to the electron beam (referred to as the focal spot) changes continuously over time. In this way, the heat generated as a result of the x-ray production process is evenly distributed across target surface 206A. However, as a result of the close proximity of bearing assembly 400 with respect to target surface 206A of anode 206, bearing assembly 400 absorbs a significant amount of heat, both by radiation and conduction. As discussed in further detail below, at least some of the heat absorbed by bearing assembly 400 is ultimately removed, preferably by x-ray tube cooling system 300.

Generally, embodiment of x-ray tube cooling system 300 include an external cooling unit 302 that continuously circulates a flow of coolant (not shown) through a reservoir 304 in which at least a portion of x-ray tube 200 is disposed. Flow of coolant into, and out of, reservoir 304 is effectuated, respectively, by way of coolant supply conduit 302A and coolant return conduit 302B. Preferably, a dielectric coolant is employed. Suitable coolants contemplated as being within the scope of the present invention include, but are not limited to, dielectric oils such as Dow Syltherm 800®, and Shell Diala Oil AX®.

In operation, a flow of coolant generated by external cooling unit 302 passes through coolant supply conduit 302A and into reservoir 304. Upon entering reservoir 304, the coolant comes into contact with various surfaces and structures of x-ray tube 200, thereby absorbing heat from x-ray tube 200. The heated coolant then exits reservoir 304 by way of coolant return conduit 302B and returns to external cooling unit 302 where it is cooled and then returned to reservoir 304 to repeat the cycle.

Figure 2:
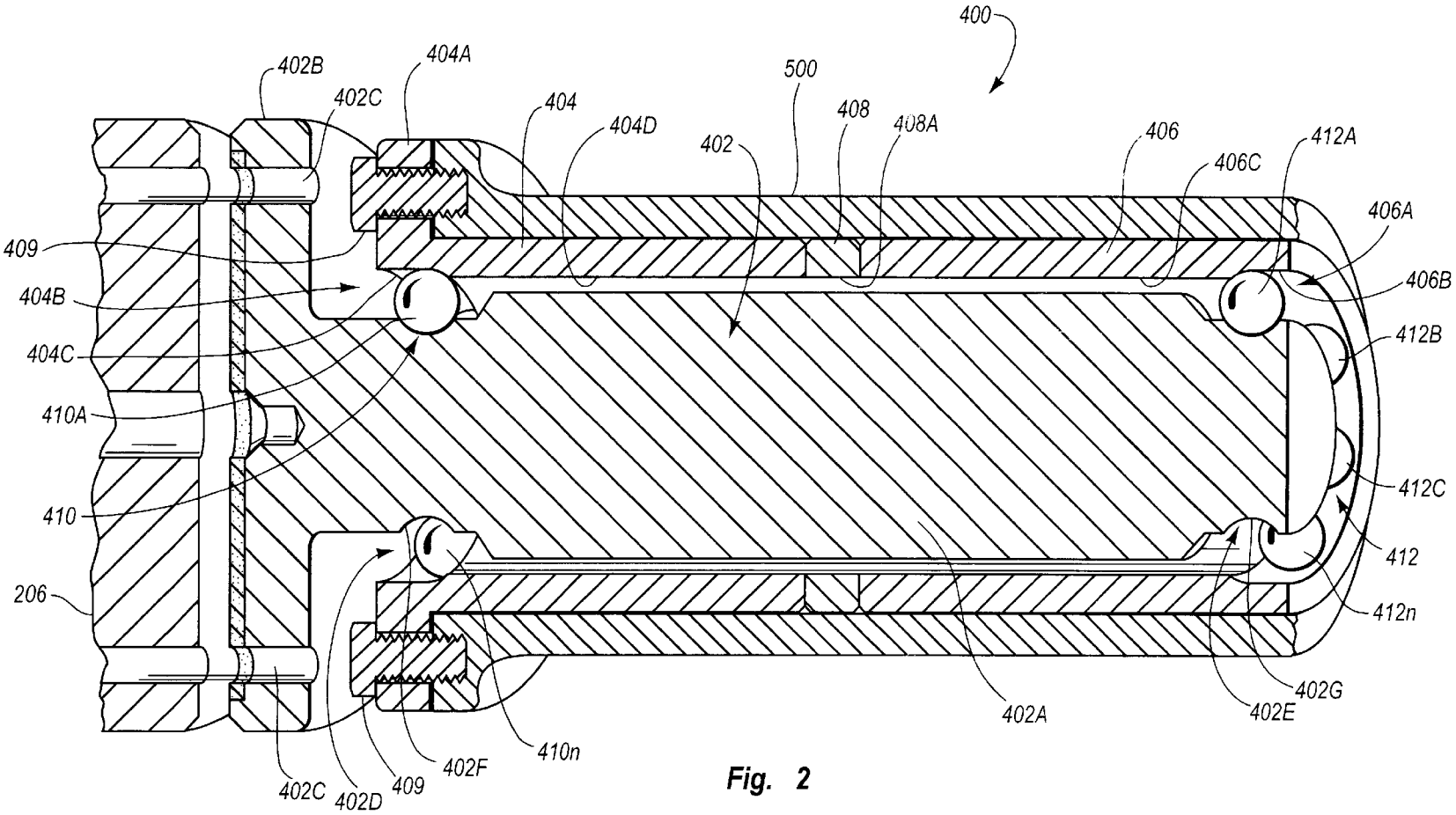
FIG. 2 is perspective view illustrating various features of an embodiment of a bearing assembly.

Directing attention now to FIG. 2, and with continuing reference to FIG. 1, various details are provided regarding an embodiment of a bearing assembly 400. In general, the bearing assembly 400 serves to rotatably support anode 206. A bearing housing 500 is found substantially in the shape of a seamless hollow cylinder and preferably comprises a durable, high strength metal or metal alloy, such as M62 Tool steel and the like, that is suitable for use in high temperature x-ray tube operating environments.

In a preferred embodiment, the bearing assembly 400 includes a shaft 402 having a body 402A and a flange 402B attached thereto. Preferably, the flange 402B is integral with the body 402A. However, it will be appreciated that flange 402B and body 402 may alternatively comprise discrete structures joined together by processes such as welding or the like. In one embodiment of the invention, the flange 402B includes a plurality of tapped or through holes 402C which align with corresponding openings in anode 206 to facilitate securement of the anode 206 to the flange 402B.

Additionally, the shaft 402 defines front and rear inner races 402D and 402E, respectively, disposed circumferentially about shaft. The front and rear inner races 402D and 402E each include respective bearing surfaces 402F and 402G. At least a portion of the body 402A, preferably at least bearing surfaces 402F and 402G, is treated or created in such a way as to enhance the rate at which heat is transferred out of bearing assembly 400. Note that, as contemplated by the present invention, such "heat transfer" includes within its purview, various mechanisms and processes by which heat may travel from one body to another, including, but not limited to, conduction and radiation.

Treatments such as those suggested above are often referred to as "blackening." Where a layer of $Fe_3O_4$ is formed, such a process or treatment may also referred to as "blueing." As is well known, the rate of radiation heat transfer is proportional to, among other things, the emissivity of the surface across which the heat is to be transferred. In general then, where there are no material differences between other relevant variables, a relatively higher emissivity implicates a relatively greater rate of heat transfer. Thus, the blackening of some or all of the shaft 402 results in a relative increase in the rate at which heat is radiated from the shaft 402, and thereby contributes to enhanced overall cooling of the bearing assembly 400.

In general, emissive coatings employed in the context of the bearing assembly 400 and its components, are characterized by various properties. For example, such emissive coatings preferably retain their compositional integrity even when subjected to the high temperature, high vacuum operating environment of an x-ray tube 200. One desirable consequence of such a feature is that little or no gas is generated by the emissive coating 300. Thus, outgassing, which may compromise the safe and effective operation of the x-ray tube 200 is substantially minimized. Additionally, the emissive coating is preferably resistant to emissivity reductions stemming from high operating temperatures. Finally, the emissive coating employed should be compatible with the substrate upon which the coating is to be disposed, or otherwise created, so as to foreclose problems such as spalling and the like.

It will be appreciated that the foregoing desirable properties of emissive coatings, layers, and the like employed in conjunction with the bearing assembly 400 are exemplary only. Accordingly, the scope of the present invention should not be construed to be limited solely to coatings, layers, and processes exhibiting one or more of the foregoing properties.

While the bearing surfaces 402F and 402G are preferably blackened, it will be appreciated that alternate, or additional, portions of the shaft 402 may likewise be blackened as required to suit a particular application and/or to facilitate achievement of one or more desired results. By way of example, portions of flange 402B may be blackened. Because the flange 402B is connected to the body 402, a relative increase in the rate at which heat is radiated out of the flange 402B serves to provide a relative reduction in the amount of heat conducted to the body 402A of the shaft 402.

It will be appreciated that blackening of a surface may be achieved through a variety of different processes. Preferably, blackening of designated surfaces is achieved simply through oxidation of the surface desired to be blackened. In the case of steel components, such as the shaft 402 (and other components discussed below), the oxidation process results in the formation of a layer of $Fe_3O_4$ (iron oxide) on the surface that was oxidized. Metal oxides such as $Fe_3O_4$ possess desirable emissive properties.

For example, M62 Tool steel, a preferred material for the shaft 402 and other bearing assembly 400 components, typically has an emissivity of about 0.75 in its oxidized state, as compared with an emissivity of about 0.25 for unoxidized M62 Tool steel. It will be appreciated that the foregoing oxidation process is exemplary only and that various other oxidation processes and environments may be employed. Generally, any oxidation process that provides for enhanced emissivity in one or more components of bearing assembly 400 is contemplated as being within the scope of the present invention.

Note that the process of oxidation, as contemplated by the present invention, is "passive" in the sense that the base metal simply undergoes a chemical reaction that results in formation of an iron oxide layer, or other desired layer. On the other hand, other blackening techniques are "active" in the sense that they involve the affirmative application of a coating or layer, such as by spraying or spattering, to a base metal. In the case of the active techniques, the base metal does not facilitate the formation of the emissive layer, as in the case of oxidation techniques and processes, but rather serves primarily as a substrate for the applied coating or layer.

It will be appreciated that because relatively smooth and uniform surfaces facilitate optimum bearing operation, the bearing surfaces 402F and 402G are preferably blackened by an oxidation process, or not blackened at all, and preferably not by processes which would result in the deposit of an emissive coating or layer which may have surface discontinuities such as lumps, peaks, valleys, and the like.

As in the case of passive processes, a variety of emissive coatings may be employed in conjunction with "active" processes. In one embodiment, the emissive coating is composed of a mixture of approximately thirteen percent (13%) titanium oxide and eighty seven percent (87%) aluminum oxide. This mixture is often referred to by the trade name "OT13," and generally possesses an emissivity of approximately 0.75.

Concerning emissivity values in general, and the emissivity value of OT13 in particular, it is generally known that metals typically have emissivity values of between 0.2 and 0.3, where 1.0 generally represents a perfect emitter and 0.0 a non-emitter. For example, in one embodiment the shaft 402 is substantially composed of M62 Tool steel. M62 Tool steel typically possesses an emissivity of about 0.25. When an OT13 emissive coating (emissivity=0.75), is applied to a M62 Tool steel shaft, it more than doubles the emissivity of the shaft. Such an increase in emissivity translates to enhanced heat dissipation from the shaft (or other blackened component or surface) thereby reducing the amount of heat present in the bearing assembly 400.

Other emissive coatings or layers may be employed to achieve this functionality. For example, an emissive coating comprising approximately forty percent (40%) titanium oxide and sixty percent (60%) aluminum oxide possesses an emissivity of about 0.85. This coating is often referred to by the trade name "OT40," and is also a suitable emissive coating for use in conjunction with the blackening of various components of the bearing assembly 400. Accordingly, metal oxides and other materials possessing these properties and characteristics are contemplated as being within the scope of the present invention.

FIG. 2 also shows additional details regarding presently preferred features of the shaft 402 that serve to enhance its thermal properties. For example, the portion of the body 402A between the front inner race 402D and the rear inner race 402E has a relatively larger diameter than the other portions of the body 402. This portion of relatively larger diameter constitutes one example of an "extended surface." As discussed in further detail below in the context of FIGS. 3 and 4, it will be appreciated that a wide variety of other extended surface configurations may be employed consistent with the teachings of the present invention.

As a result of the extended surface geometry of shaft 402, heat present in the front inner race 402D is more readily conducted to other portions of the body 402A. The concept underlying this result may be illustrated with the aid of the following model. At least some embodiments of the invention may be usefully represented by a thermal model which comprises two thermal resistors in series. A first resistor $R_1$ is defined as the total thermal radiation and conduction resistances between anode 206 and a junction point defined as the location where the balls (discussed below) of bearing assembly 400 contact bearing surface 402F. A second resistor $R_2$ is defined as the total thermal radiation and conduction resistances between this junction point and the dielectric oil (not shown), or other coolant, with which x-ray tube 200 is in contact. It will be appreciated that by lowering the resistance of $R_2$, the temperature of at least front inner race 402D and bearing surface 402F is reduced in accordance with the equation shown below (note that this equation assumes that the anode and bearing assembly are in thermal equilibrium):

$$\frac{T_{old} - T_{oil}}{T_{new} - T_{oil}} = \left(\frac{R_{2old}}{R_{2new}}\right)\left(\frac{R_1 + R_{2new}}{R_1 + R_{2old}}\right)$$

where the subscripts "old" and "new" refer to the original and new resistances and temperatures, as appropriate, and $T_{oil}$ is the temperature of the oil, or other coolant.

It will thus be appreciated that providing emissive coatings or layers on various elements or portions of bearing assembly 400, and/or increasing the cross sectional area of shaft 402, correspond to a reduction of $R_2$. In particular, because radiation heat transfer is proportional to emissivity, increasing the emissivity of a surface increases the rate of radiative heat transfer across that surface. An increase in emissivity of a surface therefore decreases the thermal resistance of elements such as, but not limited to, front inner race 402D and bearing surface 402F, and thereby results in a desirable reduction of $R_2$. Likewise, conduction heat transfer is proportional to the cross-sectional area through which heat transfer is occurring. Consequently, a relative increase in the diameter of shaft 402, and/or the use of extended surfaces on shaft 402 or other components, serves to desirably lower $R_2$.

In view of the foregoing, it will be appreciated that embodiments of the present invention provide for, among other things, the use of emissive coatings and/or relative increases in the diameter of shaft 402, and/or other geometric modifications of shaft 402, to facilitate a relatively more even heat distribution along the length of shaft 402. One result of such a relatively even heat distribution is that the temperature differential, or thermal gradient, between selected points of interest along shaft 402, such as the front inner race 402D and rear inner race 402E, is reduced. Consequently, the temperature of front inner race 402D, typically among the hottest portions of shaft 402, is reduced. This reduces the likelihood of unbalanced, or otherwise improper, rotation of shaft 402 that may occur due to unbalanced thermal expansion of the front and rear races. The effect also contributes to an increase in the lifespan of the bearing assembly 400.

With continuing attention to FIG. 2, details are provided regarding various additional components of a preferred embodiment of the bearing assembly 400. The bearing assembly 400 includes front outer race element 404 and rear outer race element 406 separated by spacer 408. In one embodiment, front outer race element 404 includes a flange 404A configured to facilitate removable attachment of front outer race element 404 to bearing housing 500 such as by bolts 409 or the like. It will be appreciated that front outer race clement 404 may be joined to the bearing housing 500 using other techniques including, but not limited to, welding, brazing, and the like.

As indicated in the illustrated embodiment, from outer race element 404 and rear outer race element 406 define, respectively, front outer race 404B and rear outer race 406A which, in turn, include respective bearing surfaces 404C and 406B. As in the case of bearing surfaces 402F and 402G, either or both of bearing surfaces 404C and 406B may be blackened, or otherwise treated to provide for a relative increase in emissivity, as required to suit a particular application and/or to facilitate achievement of one or more desired results. Alternatively, or additionally, one or both of interior surfaces 404D and 406C may be blackened or otherwise treated to increase emissivity.

Additionally, both front outer race element 404 and rear outer race element 406 are preferably in the form of a hollow cylinder so that they collectively receive at least a portion of shaft 402. Front outer race element 404 and rear outer race element 406 are positioned within bearing housing 500 with the aid of spacer 408. As in the case of interior surfaces 404D and 406C, interior surface 408A of spacer 408 may be blackened or otherwise treated to increase emissivity. It will be appreciated that variables including, but not limited to, the inside and outside diameters, thickness, length, and/or composition of the front outer race element 404, the rear outer race element 406, and/or the spacer 408, may be varied either alone or in various combinations to achieve a particular result. Finally, one or both of the front outer race element 404 and the rear outer race element 406 may include one or more extended surfaces configured and arranged to conduct heat to the bearing housing 500 or other appropriate structure.

With continuing reference to FIG. 2, the front outer race element 404, the rear outer race element 406, as well as the spacer 408, are disposed about the shaft 402. Moreover so that front outer race 404B and rear outer race 406A are substantially aligned with, respectively, front inner race 402D and the rear inner race 402E defined by the shaft 402. In this way, the front outer race 404B and the rear outer race 406A cooperate with, respectively, front inner race 402D and rear inner race 402E to confine a front ball set 410 and a rear ball set 412, respectively. Both front ball set 410 and a rear ball set 412 comprise respective pluralities of balls 410A–410*n* and 412A–412*n*. In general, the front ball set 410 and the rear ball set 412 cooperate to facilitate high speed rotary motion of shaft 402, and thus anode 206.

It will be appreciated that the variables such as the number and diameter of the balls 410A–410*n* and 412A–412*n* may be varied as required to suit a particular application. Further, in some embodiments of the invention, one or more of balls 410A–410*n* and 412A–412*n* are blackened or otherwise treated, preferably by oxidation, to provide for a relative increase in emissivity.

front outer race element 404, rear outer race element 406, spacer 408, balls 410A–410*n*, and balls 412A–412*n* are each preferably composed of a high strength metal or metal alloy, including, but not limited to, M62 Tool steel and the like. However, any other metals or metal alloys suitable for use as disclosed herein are contemplated as being within the scope of the present invention.

With continued reference to FIG. 2, heat is transmitted to the bearing assembly 400 by a variety of different vehicles. For example, heat generated at the anode 206 as a result of the x-ray generation process is conducted to the bearing assembly 400 by way of the shaft 402. Additionally, at least some of the heat generated at the anode 206 is transmitted to the bearing assembly 400 by radiation. Further, heat is also generated in front inner race 402D, the front outer race 404B, the rear inner race 402E, and the rear outer race 406A, as a result of bearing friction. Various features of embodiments of the invention, acting individually or cooperatively, serve to effectively and reliably transfer heat out of bearing assembly 400.

For example, the extended surface implemented by the relatively larger diameter of that portion of the body 402A between the front inner race 402D and the rear inner race 402E of the shaft 402 serves to facilitate improved distribution of heat throughout the shaft 402. This reduces heat concentrations in front inner race 402D and front outer race 404B. This reduction in heat serves to enhance the service life of those components, and thus the service life of the bearing assembly 400 as a whole. Further, the improved heat distribution facilitated by the large diameter portion of the shaft 402 also reduces the likelihood of improper bearing rotation, or related problems, due to large thermal gradients along the shaft 402. As suggested in FIG. 1, heat is ultimately removed from the bearing assembly 400, preferably by way of the x-ray tube cooling system 300.

During operation of the x-ray device 100, the various blackened surfaces of components of the bearing assembly 400 provide an enhanced rate of heat transfer out of bearing assembly 400. For example, the blackened surfaces of the bearing surface 402F and the exterior surface of shaft 402 increase the rate of heat transfer.

Figure 3:
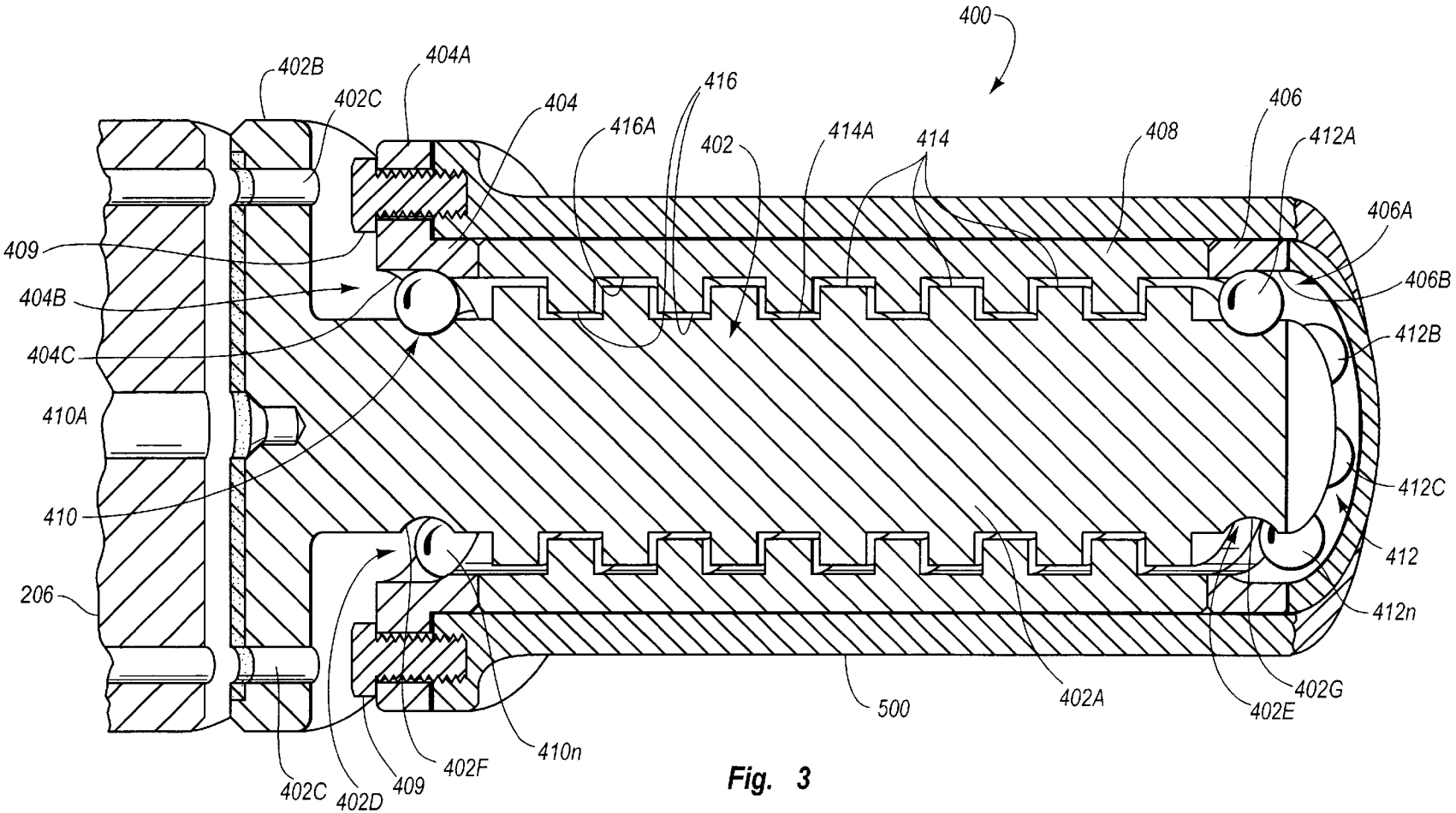
FIG. 3 is section view illustrating various features of an alternative embodiment of a bearing assembly.

Directing attention now to FIG. 3, an alternative embodiment of bearing assembly 400 is shown. Various aspects and features of the embodiment in FIG. 3 are similar to those previously discussed in the context of the embodiment in FIG. 2, and will not be repeated.

The embodiment of FIG. 3 includes a shaft 402 that has one or more extended surfaces. In the illustrated embodiment, the extended surfaces are formed on preferably annular fins 414 disposed about the periphery of the shaft 402. Preferably, the fins 414 are composed of one or more materials suitable for use in an x-ray device environment, such as high strength steels and the like. In the illustrated embodiment, extended surfaces 414 have a generally rectangular cross-section and are disposed circumferentially with respect to body 402A of shaft 402. In the embodiment shown the extended surfaces 414 are formed integral with the body 402A and are spaced apart from each other at regular intervals. It will be appreciated however, that variables including, but not limited to, the size, shape, spacing, materials, number, and arrangement of extended surfaces 414 may be varied, either alone or in various combinations, as required to suit a particular application and/or functionality. In some embodiments of the invention, one or more of the extended surfaces 414 and/or channels 414A defined by extended surfaces 414, are treated by blackening processes including, but not limited to, coating, and oxidation, so as to provide for a relative increase in emissivity.

Figure 4:
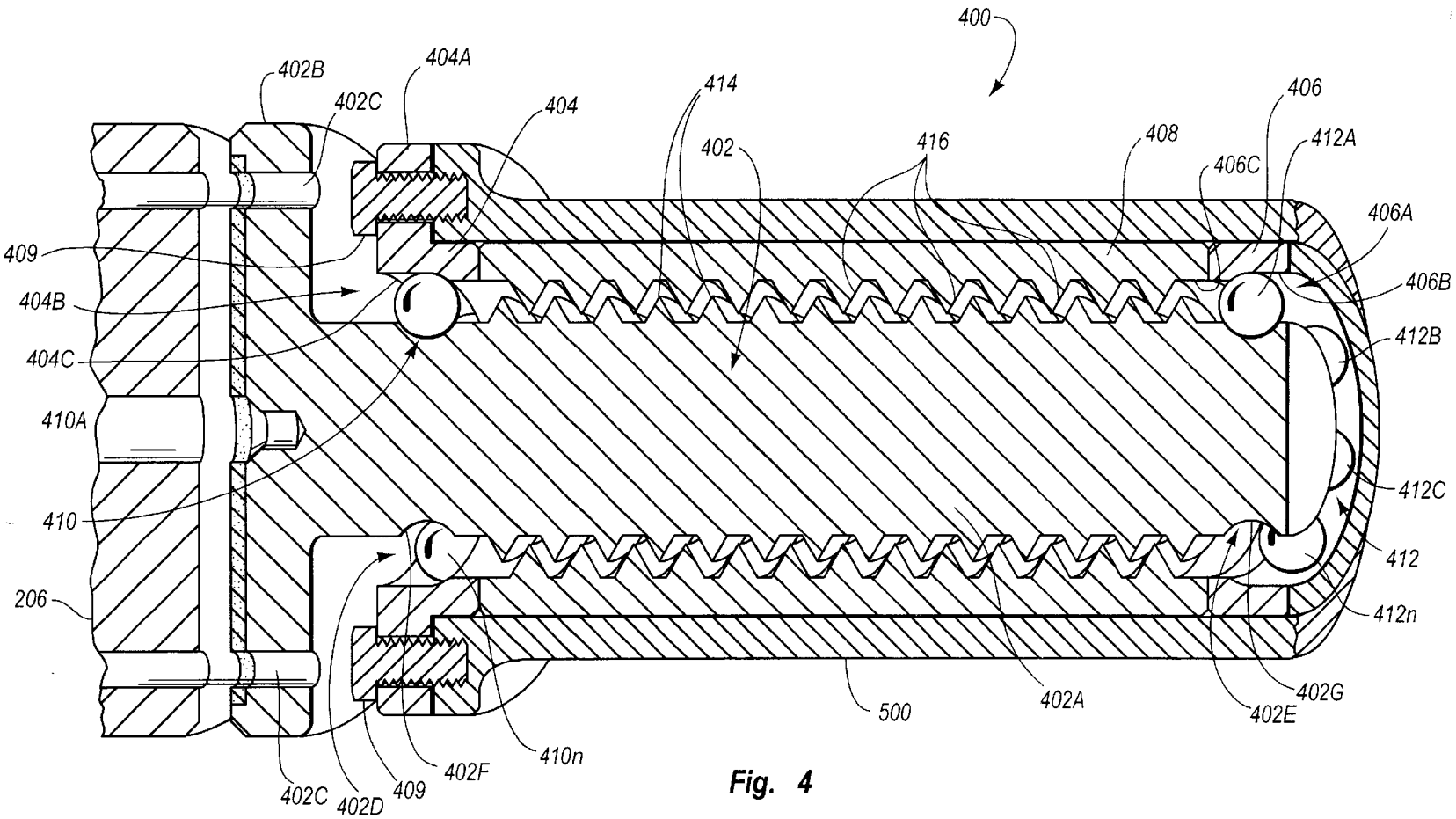
FIG. 4 is a section view illustrating various features of yet another alternative embodiment of a bearing assembly.

Various other components of the bearing assembly 400 may likewise employ extended surfaces. For example, the illustrated embodiment indicates a spacer 408 that includes a plurality of extended surfaces 416. Note that in the embodiment illustrated in FIG. 3, the spacer 408 is relatively longer, with respect to front and rear outer race elements 404 and 406, than the embodiment of the spacer 408 illustrated in FIG. 2. Such a configuration permits the extended surfaces 416 of spacer 408 to be configured in an alternating arrangement with respect to the extended surfaces 414 of shaft 402. One example of such an alternating arrangement is the interleaved configuration of extended surfaces 414 and 416 illustrated in FIG. 3. It will be appreciated that various other geometries, one of which is illustrated in FIG. 4, may be employed. Such other geometries are contemplated as being within the scope of the present invention. The invention also contemplates as within its scope arrangements where, for example, the shaft 402 includes extended surfaces, but the spacer 408 does not.

One benefit of the aforementioned alternating arrangements is that the extended surfaces 416 of the spacer 408 enhance the radiative heat transfer capability afforded by the extended surfaces 414 of the shaft 402. It will be appreciated that, consistent with the illustrated embodiment, spacer 408 is preferably divided into two portions by way of a longitudinal seam, so as to facilitate assembly of bearing assembly 400. It will likewise be appreciated that, in some embodiments of the present invention, no such seam is required.

As in the case of the extended surfaces 414, variables including, but not limited to, the size, shape, spacing, materials, number, and arrangement of the extended surfaces 416 may be varied, either alone or in various combinations, as required to suit a particular application and/or to facilitate achievement of one or more desired results. Also, the bearing assembly 400 may include a spacer 408 having extended surfaces arranged and configured to interleave with corresponding extended surfaces in bearing housing 500. In this way, the contact surface area between the spacer 408 and the bearing housing 500 is increased and thus increases the rate at which heat can be transferred from the spacer 408 to the bearing housing 500. Also, the bearing housing 500 may have one or more extended surfaces configured to provide for enhanced radiation of heat away from bearing housing 500 and into evacuated envelope 202. Additionally, one or more of the extended surfaces or channels may be treated by the previously described blackening processes including, but not limited to, coating, and oxidation, so as to provide for a relative increase in emissivity.

Directing attention now to FIG. 4, details are provided regarding yet another alternative embodiment of the bearing assembly 400. It will be appreciated that various aspects and features of the embodiment illustrated in FIG. 4 are similar to those previously discussed in the context of the embodiments illustrated in FIGS. 2 and/or 3. Accordingly, the present discussion will focus only on selected aspects and features of the illustrated embodiment.

In the embodiment illustrated in FIG. 4, the extended surfaces of the shaft 402 are substantially in the form of "teeth" 414 having a generally triangular cross section and that are disposed circumferentially around shaft 402. The extended surfaces 416 of the spacer 408 are preferably characterized by a similar tooth-shaped geometry. Note that in one alternative embodiment, the extended surfaces 414, 416 do not interleave with each other. This differs from the embodiments of FIGS. 3 and 4, where the extended surfaces 414 of shaft 402 are configured and arranged to be partly received within corresponding channels 416A of the spacer 408 and the extended surfaces 416 are configured and arranged to be partly received within corresponding channels 414A.

While the illustrated embodiments include various extended surface configurations and arrangements which serve to provide for increases in heat transfer rates, it will be appreciated that additional, or alternative, treatments of various components of the bearing assembly 400 may be employed to provide for enhanced emissivitiy and, thus, relative improvements in heat transfer rates. By way of example, selected surfaces and components of the bearing assembly 400 may be roughened, by processes including, but not limited to, chemical processes and mechanical processes such as sanding, to provide for surface area enhancement. As discussed elsewhere herein, such increases in surface area facilitate relative improvements in heat transfer rates.

To summarize, embodiments of the present invention are effective in providing for an enhanced rate of heat transfer out of the bearing assembly and related components. This improvement contributes to an increase in the operational life of both the bearing assembly 400, and related components, and the x-ray device 100 as a whole. Heat transfer rates are improved through the use of extended surfaces, emissive coatings, and/or various structural and geometric features that enhance heat distribution.

The present invention may be embodied in other specific forms without departing from its spirit or essential characteristics. The described embodiments are to be considered in all respects only as illustrative and not restrictive. The scope of the invention is therefore, indicated by the appended claims rather than by the foregoing description. All change which come within the meaning and range of equivalency of the claims are to be embraced within their scope.

What is claimed and desired to be secured by United States Letters Patent is:

1. A bearing assembly suitable for rotatably supporting an anode of an x-ray device, the bearing assembly comprising:

(a) a shaft connected to the anode, said shaft defining front and rear inner races and including at least one extended surface;

(b) front and rear outer race elements defining, respectively, a front outer race and a rear outer race;

(c) a spacer interposed between said front and rear outer race elements, the spacer comprising at least one extended surface, wherein the at least one spacer extended surface and the at least one shaft extended surface is arranged in an interleaved configuration;

(d) a front ball set confined between said front inner and outer races; and (e) a rear ball set confined between said rear inner and outer races.

2. The bearing assembly as recited in claim 1, wherein at least a portion of said shaft includes an emissive coating.

3. The bearing assembly as recited in claim 1, wherein at least one of said front and rear outer races includes an emissive coating.

4. The bearing assembly as recited in claim 1, wherein at least one of said front and rear inner races includes an emissive coating.

5. The bearing assembly as recited in claim 1, wherein at least a portion of said spacer is blackened.

6. The bearing assembly as recited in claim 1, wherein at least one of said front ball set and said rear ball set includes an emissive coating.

7. The bearing assembly as recited in claim 1, wherein at least a portion of said at least one extended surface includes an emissive coating.

8. The bearing assembly as recited in claim 1, further comprising a bearing housing inside which are received said front and rear outer race elements, said spacer, said front and rear ball sets, and at least a portion of said shaft.

9. A bearing assembly suitable for rotatable supporting an anode of an x-ray device, the bearing assembly comprising:

(a) a shaft connected to the anode, said shaft defining front and rear inner races and including at least one extended surface extending from the shaft;

(b) front and rear outer race elements defining, respectively, a front outer race and a rear outer race, at least one of said front and rear outer race elements including at least one extended surface the at least one extended surface extending toward the shaft being arranged proximate the at least one extended surface extending from the shaft;

(c) a spacer interposed between said front and rear outer race elements;

(d) a front ball set confined between said front inner and outer races; and (e) a rear ball set confined between said rear inner and outer races.

10. A bearing assembly suitable for rotatable supporting an anode of an x-ray device, the bearing assembly comprising:

(a) a shaft connected to the anode, said shaft defining front and rear inner races and including an annular fin disposed substantially about said shaft;

(b) front and rear outer race elements defining, respectively, a front outer race and a rear outer race;

(c) a spacer interposed between said front and rear outer race elements;

(d) a front ball set confined between said front inner and outer races;

(e) a rear ball set confined between said rear inner and outer races; and (f) at least one extended surface disposed on at least one of the front outer race element, the rear outer race element, and the spacer, the at least one extended surface extending toward the shaft and being arranged proximate the annular fin.

11. A bearing assembly suitable for rotatably supporting an anode of an x-ray device, the bearing assembly comprising:

(a) a shaft connected to the anode, said shaft defining front and rear inner races and including at least one extended surface extending from the shaft;

(b) front and rear outer race elements defining, respectively, a front outer race and a rear outer race;

(c) a spacer interposed between said front and rear outer race elements;

(d) a front ball set confined between said front inner and outer races;

(e) a rear ball set confined between said rear inner and outer races; and (f) at least one extended surface disposed on at least one of the front outer race element, the rear outer race element, and the spacer, the at least one extended surface extending toward the shaft, the at least one extended surface being arranged proximate the at least one extending surface extending from the shaft; and (g) a bearing housing inside which are received said front and rear outer race elements, said spacer, said front and rear ball sets, and at least a portion of said shaft, said bearing housing including at least one extended surface.

12. A shaft suitable for use in conjunction with an anode of a rotating anode x-ray device, the shaft being configured for mounting of the anode thereon, the shaft at least partially received within a bearing housing, the bearing housing including therein front and rear outer bearing race elements and a spacer interposed between the front and rear outer bearing race elements, and the shaft comprising:

(a) a body defining front and rear inner races;

(b) a flange attached to said body proximate to said front inner race; and (c) a plurality of annular fins disposed circumferentially about said shaft, wherein at least one of the front outer bearing race, the rear outer bearing race, and the spacer also includes at least one extended surface extending toward the body, the at least one extended surface being arranged proximate at least one of the plurality of annular fins.

13. The shaft as recited in claim 12, wherein each of said plurality of annular fins comprises a substantially triangular cross-section.

14. The shaft as recited in claim 12, wherein each of said plurality of annular fins comprises a substantially rectangular cross-section.

15. The shaft as recited in claim 12, wherein said plurality of annular fins is integral with said body.

16. The shaft as recited in claim 12, wherein at least a portion of said plurality of annular fins includes an emissive coating.

17. The shaft as recited in claim 12, wherein said flange is integral with said body.

18. The shaft as recited in claim 12, wherein said front inner race includes a blackened bearing surface.

19. In an x-ray device including an anode, a bearing assembly suitable for use in facilitating rotation of the anode, the bearing assembly comprising:

(a) a shaft including a flange adapted to mate with the anode, said shaft defining front and rear inner races and including a plurality of extended surfaces, at least said front inner race including a blackened bearing surface;

(b) front and rear outer race elements defining, respectively, a front outer race and a rear outer race, at least said front outer race including a blackened bearing surface;

(c) a spacer interposed between said front and rear outer race elements, and said spacer including a plurality of extended surfaces, said plurality of extended surfaces of said spacer being configured in an alternating arrangement with said plurality of extended surfaces of said shaft;

(d) a front ball set confined between said front inner and outer races;

(e) a rear ball set confined between said rear inner and outer races; and (f) a bearing housing inside which are received said front and rear outer race elements, said spacer, said front and rear ball sets, and at least a portion of said shaft.

20. The bearing assembly as recited in claim 19, wherein at least a portion of at least one extended surface of said shaft is blackened.

21. The bearing assembly as recited in claim 20, wherein said blackened portion of said at least one extended surface of said shaft comprises a metal oxide layer.

22. The bearing assembly as recited in claim 19, wherein at least a portion of said spacer is blackened.

23. In an x-ray device including an anode, a bearing assembly suitable for use in facilitating rotation of the anode, the bearing assembly comprising:

(a) a shaft including a flange adapted to mate with the anode, said shaft defining front and rear inner races and including a plurality of extended surfaces, at least said front inner race including a blackened bearing surface;

(b) front and rear outer race elements defining, respectively, a front outer race and a rear outer race, at least said front outer race including a blackened bearing surface;

(c) a spacer interposed between said front and rear outer race elements, and said spacer including a plurality of extended surfaces, said plurality of extended surfaces of said spacer being configured in an interleaved arrangement with said plurality of extended surfaces of said shaft;

(d) a front ball set confined between said front inner and outer races;

(e) a rear ball set confined between said rear inner and outer races; and (f) a bearing housing inside which are received said front and rear outer race elements, said spacer, said front and rear ball sets, and at least a portion of said shaft.

24. A bearing assembly suitable for rotatably supporting an anode of an x-ray device, the bearing assembly comprising:

a shaft connected to the anode, the shaft defining front and rear inner races and including a plurality of radially extending fins;

a front outer race aligned with the front inner race;

a rear outer race aligned with the rear inner race;

a spacer interposed between said front and rear races, the spacer including a plurality of fins extending toward the shaft;

a front ball set confined between the front inner and outer races; and a rear ball set confined between the rear inner and outer races.

25. A bearing assembly as defined in claim 24, wherein the fins of the shaft and the fins of the spacer are disposed so as to facilitate heat transfer therebetween.

26. A bearing assembly as defined in claim 24, wherein the fins of the shaft are annularly defined about the shaft surface.

27. A bearing assembly as defined in claim 26, wherein the spacer is cylindrically shaped, and wherein the fins of the spacer are disposed in an annular fashion on the spacer so as to radially extend toward the shaft.

28. A bearing assembly as defined in claim 27, wherein the fins of the shaft and the fins of the spacer are interleaved.

29. A bearing assembly as defined in claim 24, further comprising a bearing housing inside of which is received the front and rear outer races, the spacer, the front and rear ball sets, and at least a portion of the shaft.

30. A bearing assembly as defined in claim 29, wherein the bearing housing further includes at least one extended surface that extends toward the spacer.

31. A bearing assembly as defined in claim 24, wherein at least one of the front ball set, the rear ball set, the front outer race, the rear outer race, the spacer, the fins of the shaft, and the fins of the spacer includes an emissive coating.

* * * * *

UNITED STATES PATENT AND TRADEMARK OFFICE

CERTIFICATE OF CORRECTION

PATENT NO. : 6,693,990 B1 
DATED : February 17, 2004
INVENTOR(S) : Gregory C. Andrews It is certified that error appears in the above-identified patent and that said Letters Patent is hereby corrected as shown below:

Column 15,
Line 31, insert -- , -- before "the at least one"
Line 23, change "rotatable" to -- rotatably --
Line 42, insert the following paragraph:
-- (f) at least one extended surface disposed on at least one of the front outer race element, the rear outer race element, and the spacer, the at least one extended surface extending toward the shaft. --
Line 42, change "rotatable" to -- rotatably --

Signed and Sealed this

Twenty-seventh Day of July, 2004

JON W. DUDAS
*Acting Director of the United States Patent and Trademark Office*